US005417233A

United States Patent [19]

Thomas et al.

[11] Patent Number: 5,417,233

[45] Date of Patent: May 23, 1995

[54] LOW PRODUCT ALARM FOR SOLID PRODUCTS

[75] Inventors: John E. Thomas, River Falls, Wis.; Dale W. Groth, Edina, Minn.

[73] Assignee: Ecolab Inc., St. Paul, Minn.

[21] Appl. No.: 349,156

[22] Filed: Nov. 30, 1994

Related U.S. Application Data

[63] Continuation of Ser. No. 69,983, May 28, 1993, abandoned.

[51] Int. Cl.[6] ..... B08B 3/02

[52] U.S. Cl. ..... 134/93; 134/113; 137/268; 68/17 R

[58] Field of Search ..... 68/17 R; 134/93, 113, 134/57 D, 56 D, 58 D; 137/268

[56] References Cited

U.S. PATENT DOCUMENTS

| | | | |
|---|---|---|---|
| 3,152,723 | 10/1964 | Perl et al. | 68/17 R |
| 3,915,282 | 10/1975 | Remensperger | 198/30 |
| 4,009,598 | 3/1977 | Bernard et al. | 68/17 R |
| 4,555,347 | 11/1985 | O'Dowd et al. | 137/268 |
| 4,750,512 | 6/1988 | Craig | 137/268 |
| 4,845,965 | 7/1989 | Copeland et al. | 134/93 |
| 4,938,240 | 7/1990 | Laknan | 137/268 |
| 4,964,185 | 10/1990 | Lehn | 134/93 |
| 5,007,254 | 4/1991 | Wolfe et al. | 134/11 |
| 5,100,032 | 3/1992 | Burdorf et al. | 222/377 |
| 5,137,694 | 8/1992 | Copeland et al. | 137/268 X |
| 5,141,009 | 8/1992 | Morantz | 134/113 X |

FOREIGN PATENT DOCUMENTS

| | | | |
|---|---|---|---|
| 0392196 | 10/1990 | European Pat. Off. . | |
| 0533238A1 | 3/1993 | European Pat. Off. . | |
| 2921958 | 12/1980 | Germany . | |
| 3240047A1 | 5/1984 | Germany . | |
| 3513640 | 10/1986 | Germany | 134/93 |
| 3712879A1 | 11/1988 | Germany . | |
| 902192 | 3/1990 | South Africa . | |
| 2125539 | 3/1984 | United Kingdom . | |

OTHER PUBLICATIONS

Banner Engineering Corp. Brochure, "Econo--Beam TM Sensors", No. P/N 03410B8D.

"Optical Sensors: Smaller, Cheaper, Faster", Sensor Review, Jan. 1988, pp. 19-22.

Burk, "Infrared Sensors Control Thickness of Film-Co-extrusion Plies", Modern Plastics, Jan. 1984, pp. 84-88.

Elrom, "Non-Contact Optical Gauging", Advances in Instrumentation, vol. 39, Part 1, ISA International Conference, Houston, Tex., Oct. 22, 1984.

Jacobsen and Misra, "A Multi Compartment Discret Liquid Level Sensing System Using Fiber Optics and Optical Sensors", Electro-Optical Systems Design Conference, Anaheim, Calif., Nov. 11, 1975, pp. 692-698.

*Primary Examiner*—Frankie L. Stinson

*Attorney, Agent, or Firm*—Merchant, Gould, Smith, Edell, Welter & Schmidt

[57] ABSTRACT

A low product level detector is disclosed which utilizes a sensor comprised of an infrared emitter and receiver to project a beam of light across a cavity/enclosure which contains a solid product. When the product reaches a level at which more solid product should be added, an alarm indicia means is triggered. The alarm indicia means is comprised of an audible horn and a visually perceptible light. The low product alarm is utilized in a dispenser for dispensing a wash chemical solution which has been created by dissolving a solid wash chemical in a diluent. By maintaining a predetermined amount of solid wash chemical in the dispenser, the wash chemical solution maintains a more constant concentration.

18 Claims, 4 Drawing Sheets

FIG. 3
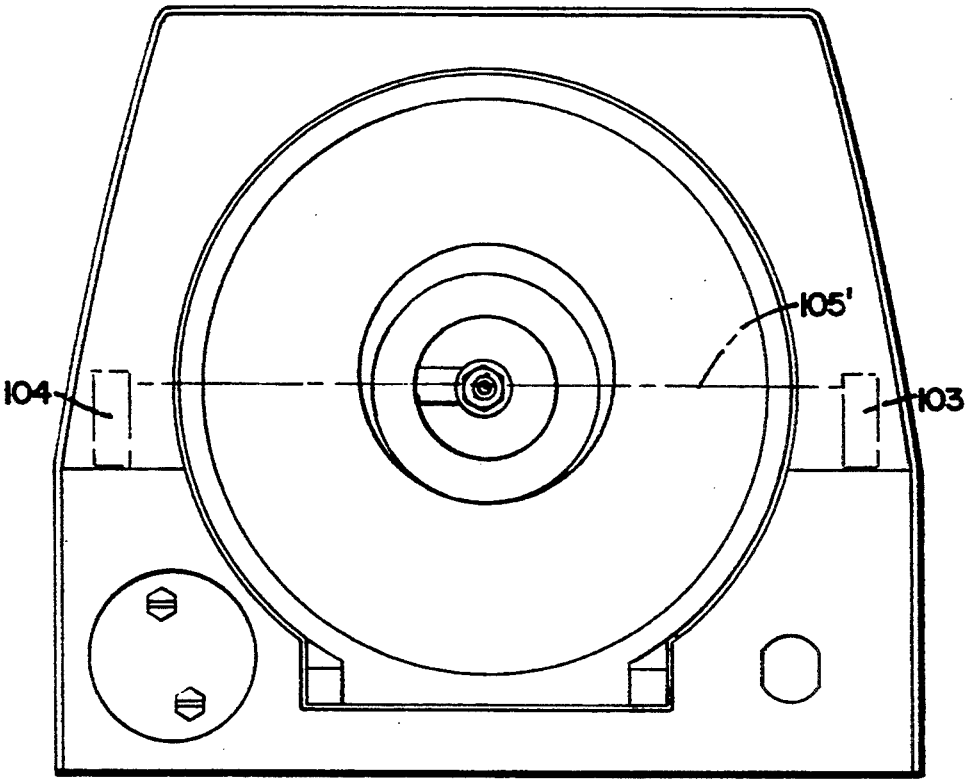
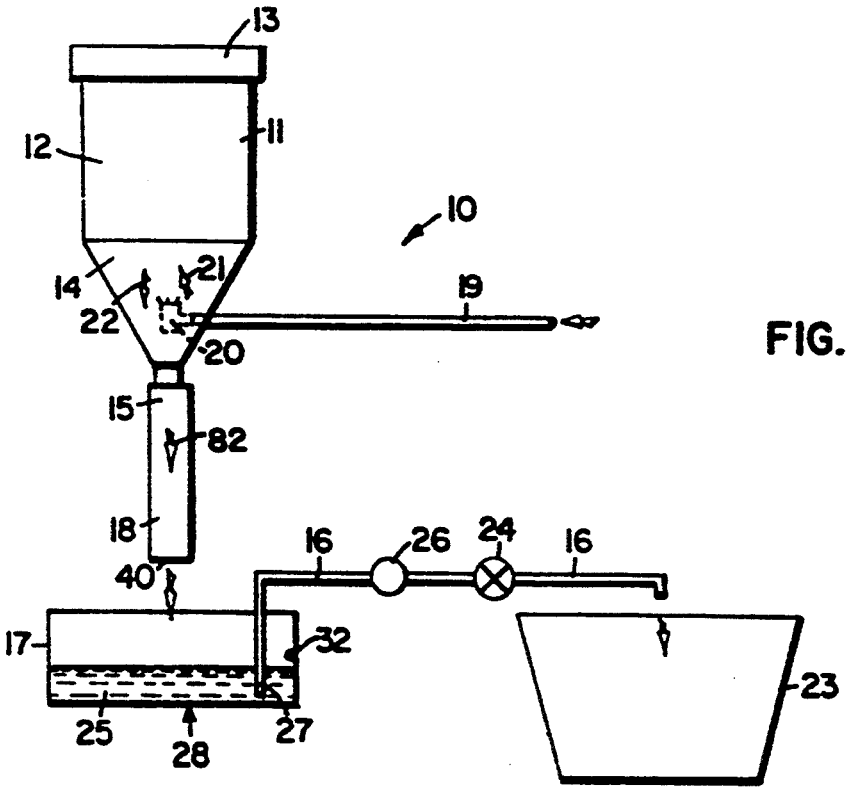
FIG. 1

LOW PRODUCT ALARM FOR SOLID PRODUCTS

This is a continuation of application Ser. No. 08/069,983, filed May 28, 1993, now abandoned.

FIELD OF THE INVENTION

The present invention relates generally to dispensers for solid products such as detergents, rinse agents, or the like; and more particularly to a dispenser of the type which creates a concentrated solution by applying a diluent to a solid product, and which includes a low product alarm for detecting and providing an indicia that replenishment of the solid product is required.

BACKGROUND OF THE INVENTION

A number of differing techniques have been developed and utilized for converting a solid cleaning composition into a concentrated cleaning solution. Examples of such cleaning solutions include detergents, rinse agents, and the like. One such employed technique uses a solid block-type cleaning composition which is placed (and thereby contained) within an enclosure. The solid block is dissolved by the impingement of a diluent upon the solid block. A common diluent is water. Use of this method typically dissolves only a portion of the solid block with each cycle. The resulting concentrated cleaning solution formed by the action of the water falls due to gravity into an underlying reservoir, or is directed by a conduit to the utilization point.

Those skilled in the art will appreciate that the utilization of solid cleaning compositions has several advantages over the use of pre-mixed liquid cleaning compositions. These advantages include that solid compositions are easier and more cost effective to ship due to its greatly-reduced weight; the solid composition requires less storage space; and the solid composition allows for a safer work environment by reducing possible splashing of hazardous chemicals. Additionally, the solid composition is more convenient for the user, and it permits easy transfer from a container to a dispenser—involving no pouring, spilling or leftover product.

A problem, however, has been encountered in the past with the foregoing dispensers. More specifically, the required and/or desired concentration of the resulting cleaning solution is maintained only as long as a minimum amount of the solid block of product is present in the dispenser prior to the activation of each cycle. When the solid block reaches a low level condition, then the resulting cleaning solution falls from the desired concentration. In one type of application, it has been empirically found that up to 200 to 300 cycles are required to reestablish the desired concentration after a low product cycle has occurred. Accordingly, there is a need to detect a low product condition level and to provide an indication of such a condition.

Despite this need, it is believed that product alarms for solid product dispensers of this type have not been utilized in the past. In other types of dispenser devices, however, measurements have been made of the resulting solution—one example being measuring the conductivity of an alkaline solution using conductivity cells. In this latter type of device, as the alkalinity decreases, the alarm sounds. Though in order to reestablish the desired concentration, the change in conductivity may occur too late in the cycle to maintain a desired constant solution concentration. Additionally, such conductivity cells are expensive and cannot be used if the solution is not conductive.

Other known types of alarms have attempted to measure colors of resulting solutions. However, color does not always produce accurate results due to wavelength variations, and so the results of such alarms have been unsatisfactory. Other devices such as thermistors, conductivity sensors, pressure sensors, vacuum, floats, and piezoelectric cells have also been attempted to be utilized in alarm devices. However, each of the foregoing has had drawbacks, and is not appropriate to the present type of dispenser since it does not directly measure the physical element which is of interest—namely the solid composition which needs periodic replenishing.

Therefore, there arises a need for a device and method in a solid to liquid dispenser for detecting a low product level, and prompting a user to replenish the solid product by providing indicia of the low product level, preferably prior to adverse impacts on the solution concentration.

SUMMARY OF THE INVENTION

The present invention provides a simple, relatively inexpensive and yet reliable method and apparatus for automatically and continuously sensing the level of solid product in a solid composition to concentrated solution dispenser. Once a low level condition is detected, a sensor circuit triggers one or more perceptible indicia that a low level condition exists. The detector is arranged and configured to detect a low level condition prior to such condition adversely affecting the solution concentration. Therefore, enough product remains in the dispenser to maintain the desired concentration of solution for a predetermined number of cycles at the time that the perceptible indicia is activated.

In a preferred embodiment constructed according to the principles of the present invention, the low level detector utilizes a sensor comprised of an infrared emitter and receiver to project a beam of light across a cavity/enclosure which contains the solid product. When the product reaches a level at which more solid product should be added, an alarm indicia means is triggered. The alarm indicia means is comprised of an audible horn and a visually perceptible light.

The preferred dispenser device in which the low product alarm is utilized comprises an apparatus for dispensing a wash chemical solution which has been created by dissolving a solid wash chemical in a diluent. The dispenser includes a sump which is positioned beneath an outlet port for the wash chemical solution. The sump collects the dissolved wash chemical. The sump is contained within a reservoir, whereby overflow of the wash chemical from the sump is collected within the reservoir. A pick-up tube is positioned to withdraw the wash chemical solution from the reservoir and transport it to the utilization point. Preferably, a screen is provided above the sump for filtering unwanted particulates.

One advantage of the present invention is the elimination or substantial reduction of concentration variances within the reservoir. It has been determined that the present invention reduces such variations, since a minimum amount of the solid chemical composition will be located within the dispenser before the low product alarm is activated. This reduction in concentration variations results in a cleaning solution which has a more consistent concentration.

Several advantages flow from eliminating variations in the concentration. First, the likelihood that pumps, or other flow control devices become clogged is reduced. Second, if the concentration is too low, the effectiveness of the chemical solutions at the utilization point is removed. Thus, by providing for consistent dispensing of the proper concentration, product waste is minimized while the efficiency is maximized. Accordingly, the cleaning product can be used to its optimum capabilities.

Another advantage of the present invention is its simplicity of construction and ease of manufacture. The present invention is relatively low in cost, and is modular in construction so that the entire assembly may be retrofitted within existing devices.

Yet another advantage is that the solid chemicals which may attach to the sides of the solid product enclosure area do not normally interfere with the operation of the low product alarm. However, the block of solid chemicals does provide an opaque screen to the light from the emitter to the sensor (i.e., the sensor remains turned off until light strikes it) such that the presence of the desired and/or predetermined amount of solid chemical causes the device to operate in its intended manner.

Therefore, according to one aspect of the invention, there is provided a dispenser of the type which forms and dispenses a solution formed by dissolving a solid wash chemical in a diluent, comprising: a) a container for holding a predetermined amount of a solid wash chemical; b) diluent application means for impinging a diluent onto the solid wash chemical within said container, wherein a solution is formed for subsequent use at a utilization point; c) solution collection means for collecting said solution; and d) detector means operatively located proximate said container, said detector means including: i) an emitter for emitting a beam through said container; and ii) a receiver for receiving the emitted beam from said emitter and determining when the solid wash chemical needs replenishment.

While the invention will be described with respect to a preferred embodiment circuit configuration and with respect to particular circuit components used therein, it will be understood that the invention is not to be construed as limited in any manner by either such circuit configurations or circuit components described herein. Further, while the preferred embodiment of the invention will be described in relation to a cleaning product dispenser, and more specifically to a rinse additive solid product dispenser, it will be understood that the scope of the invention is not to be limited by the environment in which it is employed.

Other, advantages and features which characterize the invention are pointed out with particularity in the claims annexed hereto and forming a part hereof. However, for a better understanding of the invention, its advantages and objectives obtained by its use, reference should be had to the drawing which forms a further part hereof and to the accompanying descriptive matter, in which there is illustrated and described a preferred embodiment to the invention.

BRIEF DESCRIPTION OF THE DRAWINGS

Referring to the Drawings, wherein like numerals represent like parts throughout the several views:

FIG. 1 is a schematic block diagram of a dispensing system of the type which employs the principles of the present invention;

FIG. 3 is a top plan view of the dispenser of FIG. 1 with the location of the low product alarm emitter 103, receiver 104, and light path 105 illustrated in phantom;

DETAILED DESCRIPTION OF A PREFERRED EMBODIMENT

As mentioned above, the principles of this invention apply to the automatic detection of a low solid product condition occurring in a dispenser of the type which dilutes the solid product with a diluent to form a predetermined concentration (or concentration range) of liquid solution in a reservoir. The present invention provides for perceptible indicia when such solid product becomes low or otherwise reaches a predetermined level. Therefore, variations in the liquid solution concentration are minimized. A preferred application for this invention is in the monitoring and detecting of a low solid product condition in a wash chemical, and more specifically a rinse additive environment. Such application is typical of only one of the innumerable types of applications in which the principles of the present invention can be employed.

In order to better facilitate an understanding of the present invention, a description of the low product alarm will be deferred pending a discussion of a preferred embodiment dispensing system.

DISPENSER 10

Figure 2:
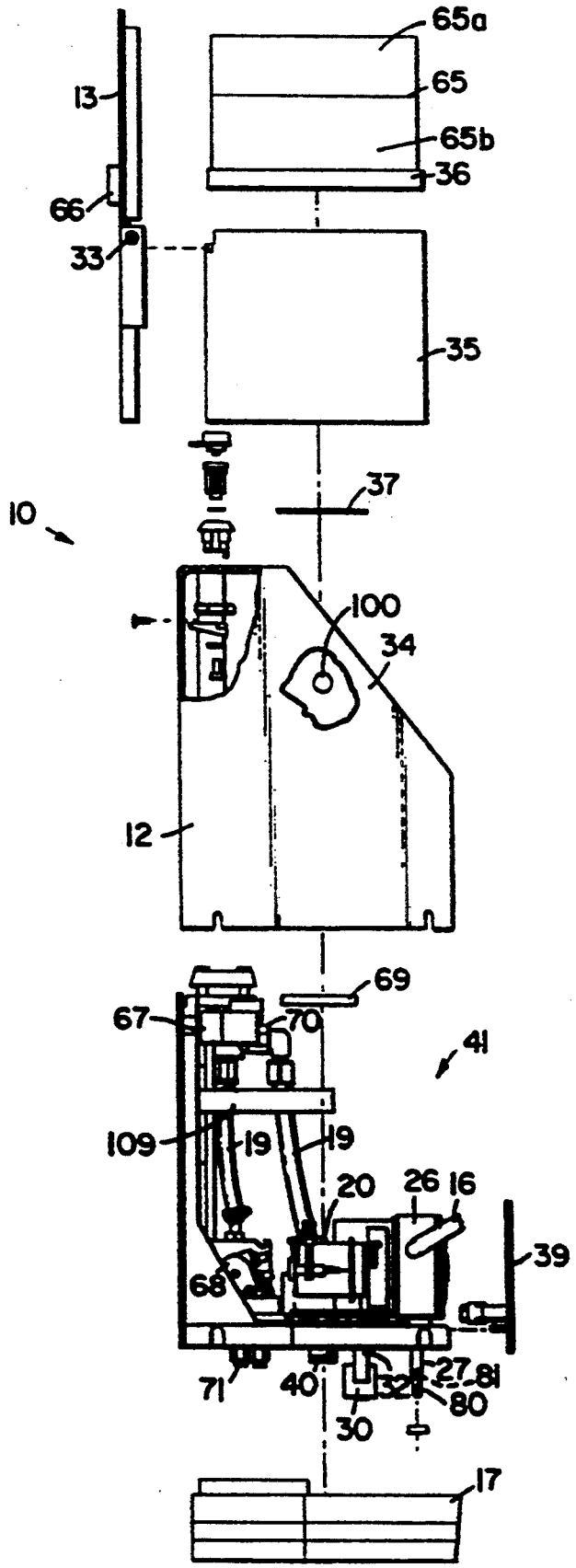
FIG. 2 is a side elevational and exploded view of the dispenser of FIG. 1 illustrating the location of the sensor bracket 109, and with portions of hood 34 broken away to illustrate the location of the aperture 100 for the low product alarm 90 constructed according to the principles of the present invention.

Referring first to FIG. 1, a dispensing system is indicated generally at 10. The dispensing system 10 has a container or housing 11 with an upper storage portion 12 for holding a solid cleaning composition 65 (best seen in FIG. 2). In the preferred embodiment, several blocks may be placed within the upper storage portion 12. FIG. 2 illustrates two blocks 65*a* and 65*b*.

A door 13 extends across the upper end of the storage portion 12 to provide access to the cavity within the storage portion 12. At the lower end of the container 11 is a collector portion 14. The lower end of the collector portion 14 defines an outlet port 15 for passage therethrough of solution collected by collector portion 14. Conduit 18 extends from the outlet port 15 to terminate at a position directly overlying the reservoir 17. The outlet port 15 directs the wash chemical solution downwardly as illustrated by the arrow 82 by gravity. If the wash chemical is not fed by gravity, a wash chemical solution pump (not shown) could be provided in the outlet conduit 18.

A water supply inlet pipe 19 is connected to the container, 11 and is in communication therewith for providing a source of water flow to a spray-forming nozzle 20. The spray nozzle 20 directs water upwardly as shown by the arrow 21 so as to impinge upon the solid block of chemical 65, at which time the resulting liquid cleaning solution descends through the collector portion 14 as shown by the arrow 22.

Control of the dispensing of the wash chemical solution from the dispenser housing 11 is done by controlling the flow of water to spray nozzle 20. This may be done in a number of ways including mechanical means such as hydraulic timer valves and electrical means such as electrical switching in the control system (not shown) of the utilization vehicle 23 (i.e., a ware washing machine, washing machine, etc.). In the preferred embodiment, the product 65 is a rinse additive which is added to a water line at mixer 24. Thereafter, conduit 16' carries the mixed water and liquid product to utilization point 23. Also located at mixer 23 is a pressure switch 102 (best seen in FIG. 5) which monitors the pressure of the water being delivered to utilization point 23. The switch 102 closes when water is being delivered. Therefore, the dispenser 10 only operates when the liquid product is required at the utilization point 23. Those skilled in the art will appreciate that other time periods for operation may be desired. The interconnection of the main functional electrical components of dispenser 10 are more clearly seen in FIG. 5.

The dissolved cleaning solution 25 is collected within the reservoir 17 where it is available for use when necessary by the utilization vehicle 23. Supply conduit 16, 16' transports the cleaning solution to the utilization vehicle 23, the supply conduit 16, 16' having a pump 26 and other suitable flow control means. In the preferred embodiment, the pump 26 is a peristaltic pump. A pick-up tube 27 extends within the reservoir 17 proximate the bottom wall 28 of the reservoir 17 to withdraw the cleaning solution.

In the preferred embodiment, a float is positioned within the reservoir 17 and operatively connected to a float switch 32. The float switch 32 is operatively connected to spray control means (such as solenoid valve 68) for controlling the flow of water to the nozzle 20, in order to maintain a constant level of wash chemical solution in the reservoir 17. When the level of wash chemical solution in the reservoir 17 is below the desired constant level, the float switch 32 is electrically closed and the spray control means is opened so that additional wash chemical solution 25 is formed until the float 30 returns to its desired level.

Turning now to FIG. 2, an exploded view of the dispenser assembly 10 is illustrated. The dispenser 10 is preferably configured so that it can be mounted upon a wall near the utilization vehicle 23. The container 12 preferably has a hood 34, the upper portion of which contains the housing 35 for the solid cleaning product 65 and the lower portion of which contains the flow control assembly 41. The hood 34 is preferably made of a stainless steel or molded plastic material.

Hood 34 preferably includes two apertures 100 and 101 formed therein which are sized and oriented through the center line of the dispenser 10. The apertures 100, 101 are located at a predetermined height within dispenser 10, wherein the low product alarm 90 (discussed in more detail below) detects a low product condition prior to actually running out of product. Preferably, the low product alarm 90 in enabled when the solid product drops to a level where the height of the remaining product is equal to the height of one block 65 remaining in the storage portion 12. Sensor bracket/-flange 109 is mounted within container 12, and is arranged and configured to place emitter 103 and receiver 104 (discussed below) in operative position relative to apertures 100 and 101 respectively. The preferred orientation the sensors 103, 104 is proximate apertures 100, 101 and forming a line starting with emitter 103, continuing through the center of aperture 100, continuing through the center of aperture 101, and ending at receiver 104. Those skilled in the art will appreciate that any number of other orientations of the sensors may be provided in order to monitor the amount of solid product remaining in the dispenser 10.

The size and shape of the housing 35 conforms with the size and shape of the solid product capsule 65 and is preferably cylindrical. A front panel assembly 39 is attachable to the front portion of the hood 34. The housing 35 is made of a clear or translucent plastic material, or contains a clear window, so as to enable an operator to visually discern the level of solid wash composition 65 contained therein. Additionally, in the preferred embodiment, the housing 35 must be constructed of a material which does not interfere with the low product alarm 90. Thus, clear or translucent plastic is preferred. However, those skilled in the art will appreciate that other types of material might be used which are opaque. In that event, either additional apertures or plastic inserts (i.e., translucent or clear inserts) can be provided.

The door 13 is connected to the container 12 by means of a hinge 33. In the preferred embodiment, there is a magnet 66 on the cover 13 which controls the opening and closing of a proximity switch 67. Opening of the cover 13 causes the proximity switch 67 to open and to turn off operation of the solenoid valve 68 which controls water flow. This provides a safety feature to prevent the operator's exposure to the wash chemical 65.

Grates 36 and 37 are preferably positioned below the solid detergent capsule 65, with the grate 36 having relatively large apertures and supporting the solid wash chemical 65. The grate 37 is positioned within the hood 34 and has relatively small apertures, on the order of one-half inch in diameter in the preferred embodiment, so as to trap undesirable particles from entering the wash chemical solution.

There is a seal 69 which serves as a divider between the wetted wash chemical portion of the dispenser 10 above the seal 69 and the electronic flow control assembly 41 below the seal 69. The seal 69 could be a U-cup, an O-ring or any other suitable configuration.

The water enters the dispenser's water supply line 19 at water inlet point 71. The water line 19 is provided with a vacuum breaker assembly 70 which prevents backflow of the wash chemical into the water supply line. The cleaning solution then exits into the reservoir 17 at outlet port 40. The wash chemical solution is withdrawn from reservoir 17 by means of the pick-up tube 27 and the pump 26. The cleaning solution is then directed to the utilization vehicle 23 via conduit 16, 16'.

At the lower end of the dispenser assembly 10 is the reservoir 17. In the preferred embodiment, the reservoir 17 is made of a plastic material such as polymethylpentene or polypropylene, and is formed of a single, unitary piece. These types of plastic material are transparent and have resistance to heat and chemicals. Preferably, the reservoir 17 is made of a transparent or translucent material to allow the operator to see the amount of wash chemical in the reservoir 17.

The reservoir 17 includes a sump (not shown) within the reservoir 17. A sump of the type utilized in dispenser 10 is more fully discussed in issued U.S. Pat. No. 5,100,032 which is hereby incorporated herein by reference. Positioned within the reservoir 17 is a pick-up tube 27. When cleaning solution is needed in the utilization vehicle 23, the pump 26 is energized and cleaning solution is withdrawn from the reservoir 17 via the pick-up tube 27. The bottom of the pick-up tube 27 is positioned slightly above the bottom of the reservoir 17, preferably approximately an eighth of an inch. The pick-up tube 27 is preferably made of a polypropelene material. The pick-up tube 27 contains a suitable flow indicator 80 such as one having a ball float 81, to enable the operator to visually monitor flow of the wash chemical from the reservoir 17.

The dispenser outlet 40 is positioned directly above the sump, so that the cleaning solution dispenses into the sump 48. It then overflows into the main reservoir 17. In the preferred embodiment, each dispensing cycle produces approximately 70 milliliters of liquid. As used herein, the term "dispensing cycle" refers to a single activation of the float switch 32. The switch may be activated more than once during a single cleaning cycle of the utilization vehicle 23.

In the preferred embodiment, the volume of the reservoir 17 is enough for approximately five to ten cycles in the utilization vehicle 23. By making up a quantity of chemical solution 25 and storing it in the reservoir 17, the solution is immediately available whenever the utilization vehicle 23 requires it.

LOW PRODUCT ALARM 90

Figure 5:
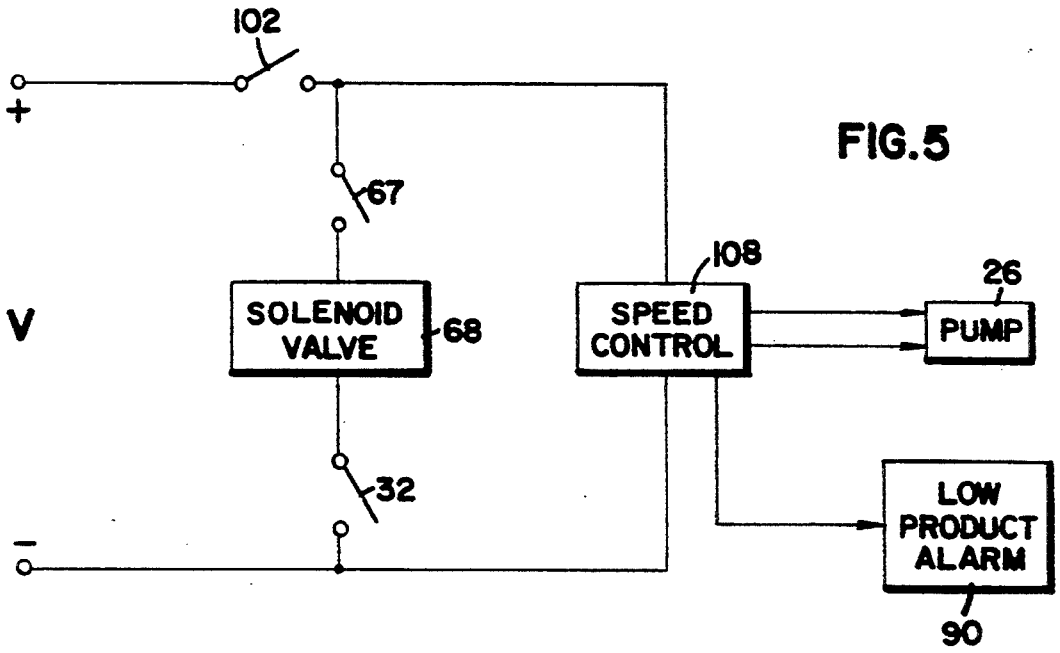
FIG. 5 is a functional block diagram illustrating the various electrical components of the dispenser 10 of FIG. 1 and the low product alarm 90.

Turning now to FIG. 5, a functional block diagram of the electrical elements of dispenser 10 and low product alarm 90 is illustrated. In the preferred embodiment, the low product alarm 90 is used in a dispenser for a liquid rinse additive. Accordingly, the rinse additive is required only when hot rinse water is being used. Thus, as noted above, pressure switch 102 only closes when the utilization vehicle 23 is using rinse water (i.e., hot rinse water is being delivered).

Switch 67 is a cover safety switch which avoids turning on the solenoid valve 68 as discussed above. Also in series with switch 67 and valve 68 is float switch 32. Those skilled in the art will appreciate that solenoid valve 68 only turns on (i.e., opens to allow spray nozzle 20 to spray block 65) when pressure switch 102 indicates that water is being used at the utilization vehicle 23, the cover switch 67 is closed, and the float switch 32 indicates that additional solution 25 is required.

On a parallel circuit, but also in series with pressure switch 102, is the speed controller 108 for controlling the speed of the motor for pump 26. In the preferred embodiment, the controller 108 provides a source for a regulated voltage. Therefore, the low product alarm 90 is connected at this location. Those skilled in the art will appreciate that any other regulated voltage source may be provided in order to power low product alarm 90. Also, while not specifically detailed in FIGS. 5 and 6, it will be understood that the functional blocks, and other devices, are properly connected to appropriate bias and reference supplies so as to operate in their intended manner.

Figure 4:
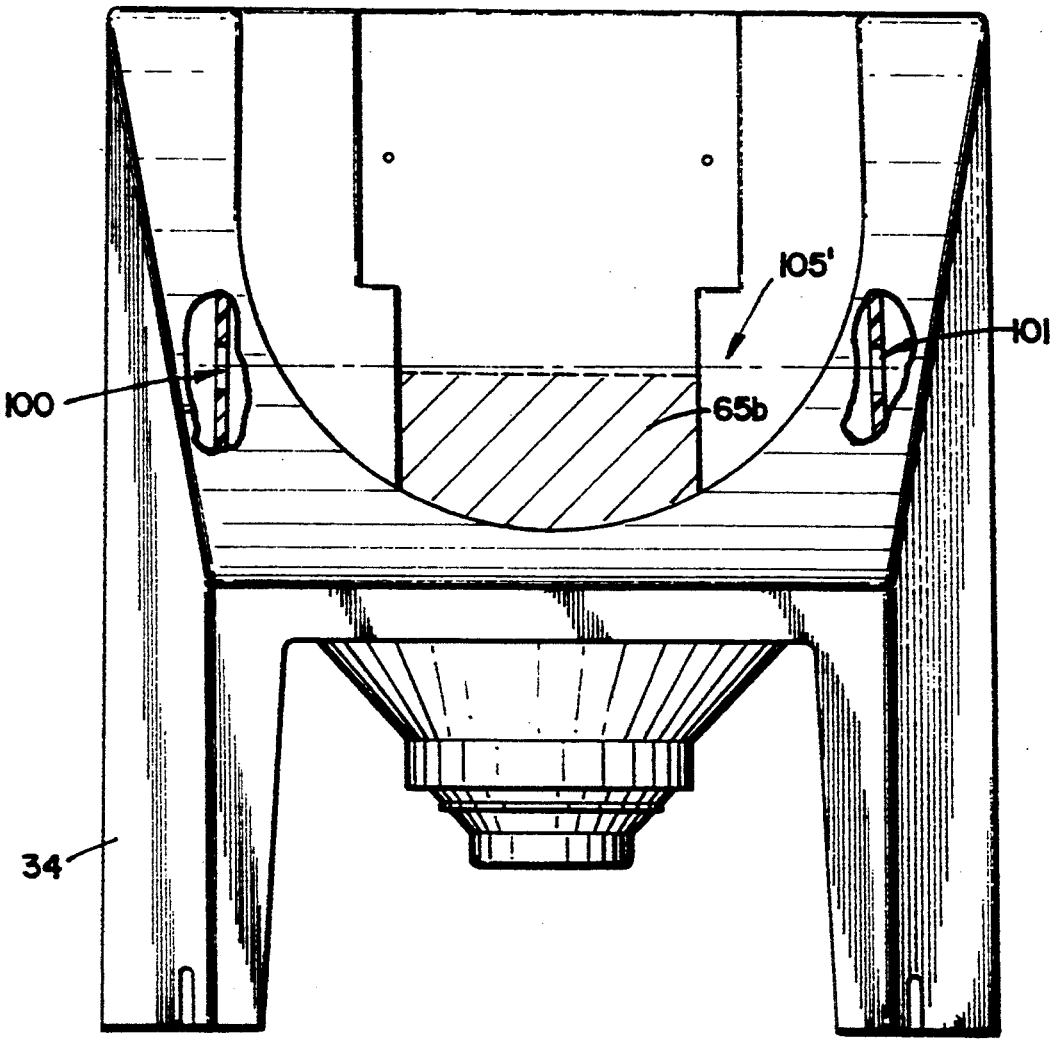
FIG. 4 is a front elevational view of the dispenser 10 of FIG. 1 with portions broken away to illustrate the location of the apertures 100, 101 for the low product alarm 90.
Figure 6:
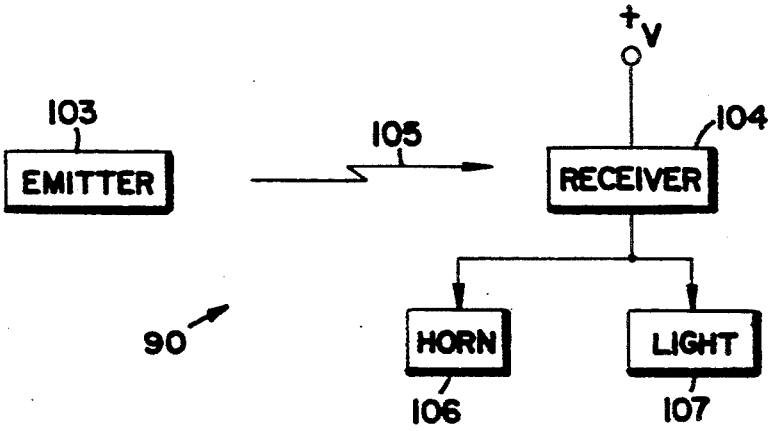
FIG. 6 is a functional block diagram illustrating the functional components of low product alarm 90 constructed in accordance with the present invention.

Next referring to FIG. 6, a more detailed functional block diagram of the electrical components of low product alarm 90 is illustrated. First, emitter 103 generates an infrared beam 105. The beam 105 preferably travels through the aperture 100 and through the transparent housing 35. If no opaque solid product 65 blocks the light 105 along path 105' (illustrated in FIG. 4, where solid block **65*b* lies below the light path line 105'), then the beam 105 continues through the other side of housing 35, through aperture 101 and strikes the operative light sensitive surface of receiver 104**.

The receiver 104 is normally off in operation (i.e., it acts as a switch which turns on when a beam is incident on the operative surface of the receiver 104). However, when the beam 105 strikes the receiver 104, then it turns on and provides a voltage to operate the perceptible indicia means comprised of horn 106 and light 107. When solid block 65 lies within path 105', then receiver 104 remains off. Thus, receiver 104 acts as a means for determining whether a predetermined amount of solid block 65 is present.

The perceptible indicia are preferably located such that they can be heard and seen respectively by users of dispenser 10. Thus, light 107 is preferably located on the front of dispenser 10 and the horn 106 is placed through the bottom or side wall of dispenser 10. Alternatively, the perceptible indicia may be located in a remote location from dispenser 10 if the location is more perceptible to a user. Also, a variable resistor (not shown) may be placed in line with horn 106 to vary the volume of the horn 106.

When the low product alarm 90 detects a low solid block 65 condition, the perceptible indicia means are turned on to alert a user that the solid block 65 requires replenishment. This maintains the solution 25 at a more uniform concentration level and maximizes the efficiency of the chemical. By directly monitoring the height of solid block 65 within the dispenser 10, a simple and effective method of monitoring the concentration level of solution 25 is achieved.

It will be appreciated by those skilled in the art that the low product alarm 90 may be connected to a reference voltage supply in at least one of two optional configurations. First, the low product alarm 90 may be connected so as to continuously monitor the block 65 and/or continuously trigger an alarm in the event of a low product condition. Second, the low product alarm may be connected so as to ,only monitor the block 65 and/or trigger an alarm when pressure switch 102 is closed.

In the preferred embodiment, emitter 103 and receiver 104 are manufactured by Banner Engineering Corporation of Minneapolis, Minn. and have the designation SE61E and SE 61R respectively. Those skilled in the art will appreciate that other emitters and receivers might be used. Factors used in selecting the sensors include operation in both light and dark environments, temperature and chemical resistance, voltage fluctuation rejection, and ability to operate through housing 35 even when contaminated with elements of solid block 65. In the preferred embodiment, horn 106 is an alarm manufactured by Mallory and having the designation SONALERT SC628.

Even though numerous characteristics and advantages of the invention have been set forth in the foregoing description, together with the details of the structure and function of the invention, the disclosure is illustrative only, and changes may be made in detail, especially in matters of shape, size, and arrangement of parts, within the principles of the invention, to the full extent indicated by the broad, general meaning of the appended claims.

What is claimed is:

1. A dispenser of the type which forms and dispenses a solution, the solution formed by dissolving a solid wash chemical in a diluent, comprising:

a) a container for holding a predetermined amount of a solid wash chemical;

b) diluent application means for impinging a diluent onto the solid wash chemical within said container, wherein a solution is formed for subsequent use by a utilization vehicle;

c) solution collection means for collecting said solution; and d) light detector means operatively located proximate said container, said detector means including:

i) an emitter for emitting a beam of light through said container; whereby the beam of light is blocked by the solid wash chemical when at least a predetermined approximate amount of the solid wash chemical is present in said container; and ii) a receiver for receiving the beam of light from said emitter and automatically determining when the solid wash chemical needs replenishment based on whether the beam of light reaches said receiver.

2. The dispenser of claim 1, wherein said container is opaque and includes apertures through which the beam of light travels.

3. The dispenser of claim 1, wherein said container is either clear or translucent.

4. The dispenser of claim 1, wherein said receiver acts as a switch and triggers perceptible indicia when the beam strikes said receiver, wherein a user is alerted to replenish the solid wash chemical.

5. The dispenser of claim 4, wherein said perceptible indicia includes an alarm and a light.

6. The dispenser of claim 5, wherein said alarm and said light are located on the dispenser.

7. The dispenser of claim 1, wherein said receiver is operative only when the utilization vehicle is operative.

8. The dispenser of claim 7, wherein said utilization vehicle is a ware washer having a rinsing mode, wherein the solid wash chemical is a rinse additive, and wherein the beam of light is generated by said emitter only when the ware washer is in said rinsing mode.

9. The dispenser of claim 1, wherein said emitter and receiver are arranged and configured such that when less than said predetermined approximate amount of the solid wash chemical remains in the dispenser, said perceptible indicia are triggered, whereby an operator is alerted to replenish the supply of the solid wash chemical before the supply of the solid wash chemical is exhausted and whereby the solution remains at a generally constant concentration.

10. The dispenser of claim 1, wherein said receiver is normally off until the beam of light strikes said receiver.

11. The dispenser of claim 1, wherein the beam of light is infrared.

12. A low product alarm for use in a dispenser, the dispenser being of the type which forms and dispenses a solution formed by dissolving a solid wash chemical located in a container with a diluent over a number of dispensing cycles, the low product alarm comprising:

i) an emitter for emitting a beam through the container at a predetermined point, whereby the beam is blocked by the solid wash chemical when at least a predetermined approximate amount of the solid wash chemical is present in the container, and whereby when the solid wash chemical is dissolved it exits from the container over a number of dispensing cycles so that the solid wash chemical is reduced during use to a point below said predetermined point;

b) a receiver for receiving the beam from said emitter when the solid wash chemical does not block the beam; and c) determining means for automatically determining when the solid wash chemical needs replenishment based on whether the beam reaches said receiver.

13. The dispenser of claim 12, wherein said receiver acts as a switch, and said switch comprises said determining means and triggers perceptible indicia when the beam strikes said receiver, wherein a user is alerted to replenish the solid wash chemical.

14. The dispenser of claim 13, wherein said perceptible indicia includes an alarm and a light.

15. The dispenser of claim 14, wherein said emitter and receiver are arranged and configured such that an approximate predetermined amount of the solid wash chemical remains in the dispenser when said perceptible indicia are triggered, whereby the resulting solution remains at a generally constant concentration.

16. A combination low product alarm and dispenser, the dispenser being of the type which dispenses a solution formed by dissolving a solid wash chemical with a diluent, comprising:

a) a frame;

b) a container attached to said frame for holding a predetermined amount of a solid wash chemical;

c) diluent application means for impinging a diluent onto the solid wash chemical within said container, wherein a solution is formed for subsequent use by a utilization vehicle;

d) solution collection means for collecting said solution;

e) a detector flange, cooperatively connected to said frame and located proximate said container; and f) detector means, operatively mounted to said detector flange, said detector means including:

i) an emitter for emitting a beam through said container at a predetermined point, whereby when the solid wash chemical is dissolved it exits from said container over a number of dispensing cycles so that the solid wash chemical is reduced to a point at or below said predetermined point;

ii) a receiver for receiving said beam from said emitter when the solid wash chemical does not block said beam; and iii) determining means for determining when the solid wash chemical needs replenishment based on whether said beam reaches said receiver.

17. The dispenser of claim 16, wherein said container is opaque and includes apertures through which the beam travels.

18. A dispenser of the type which forms and dispenses a solution, the solution formed by dissolving a solid wash chemical in a diluent, comprising:

a) a container for holding a predetermined amount of a solid wash chemical;

b) diluent application means for impinging a diluent onto the solid wash chemical within said container, wherein a solution is formed for subsequent use by a utilization vehicle;

c) solution collection means for collecting said solution;

d) detector means operatively located proximate said container, said detector means including:

i) an emitter for emitting a beam through said container; and ii) a receiver for receiving the beam from said emitter and determining when the solid wash chemical needs replenishment based on whether the beam reaches said receiver, wherein said receiver is operative only when the utilization vehicle is operative; and e) wherein said utilization vehicle is a ware washer having a rinsing mode, wherein the solid wash chemical is a rinse additive, and wherein the beam is generated by said emitter only when the ware washer is in said rinsing mode.

* * * * *